United States Patent [19]

Sato

[11] Patent Number: 4,533,821

[45] Date of Patent: Aug. 6, 1985

[54] HEATING SHEET

[76] Inventor: Ryoda Sato, 8-25 Obamacho 1-chome, Amagasaki-shi, Hyogo-ken, Japan, 661

[21] Appl. No.: 532,407

[22] Filed: Sep. 15, 1983

[30] Foreign Application Priority Data

Dec. 11, 1982 [JP] Japan ..... 57-216283

[51] Int. Cl.[3] ..... H05B 3/34

[52] U.S. Cl. ..... 219/545; 219/529; 219/549; 219/211; 338/208

[58] Field of Search ..... 219/211, 212, 217, 345, 219/527, 528, 529, 545, 548, 541, 549; 338/308, 338/210, 211, 212

[56] References Cited

U.S. PATENT DOCUMENTS

| | | | |
|---|---|---|---|
| 2,327,756 | 8/1943 | Adamson | 219/545 |
| 2,669,646 | 2/1954 | Ford | 219/545 X |
| 2,884,509 | 4/1959 | Heath | 338/208 |
| 2,938,992 | 5/1960 | Crump | 219/545 X |
| 3,349,359 | 10/1967 | Morey | 338/208 |
| 3,425,020 | 1/1969 | Toyooka et al. | 338/208 |
| 3,513,297 | 5/1970 | Jordan | 219/545 |
| 3,946,194 | 3/1976 | Bretoniere | 219/545 X |

FOREIGN PATENT DOCUMENTS

| | | | |
|---|---|---|---|
| 253525 | 6/1927 | Italy | 219/545 |
| 553804 | 6/1943 | United Kingdom | 219/545 |
| 1210138 | 10/1970 | United Kingdom | 219/545 |

*Primary Examiner*—Volodymyr Y. Mayewsky
*Attorney, Agent, or Firm*—Burgess, Ryan & Wayne

[57] ABSTRACT

A plurality of heating wires are arranged so as not to cross each other. Common power source terminals are connected to two end portions or at an intermediate portion of each heating wire. Each common power source terminal has a plurality of conductors which cross the heating wires. The heating wires and/or the conductors are fixed on one surface of the nonconductive fiber sheet or are woven thereinto.

12 Claims, 15 Drawing Figures

HEATING SHEET

BACKGROUND OF THE INVENTION

The present invention relates to a heating sheet used for heating a body of a user or for keeping him warm.

Conventionally, electric heaters or any other heating equipment for heating the body of a user or keeping him warm use a single Nichrome wire arranged in a spiral or zigzag pattern. However, when a disconnection occurs at a part of the Nichrome wire of the conventional electric heater or any other heating equipment of this type, heating or warming is interrupted, resulting in inconvenience. Furthermore, the Nichrome wire is heated to a higher temperature than is required for heating the user or keeping him warm. When a flammable material is disposed in the vicinity of the Nichrome wire, a fire may occur. Furthermore, all of the heat produced from the Nichrome wire cannot be used for directly heating the user or keeping him warm. As a result, the electric heater or any other heating equipment has a low efficiency, thus resulting in a lack of economy.

SUMMARY OF THE INVENTION

It is, therefore, an object of the present invention to provide a safe, economical and convenient heating sheet which overcomes the aforementioned problems of prior art heating sheets.

It is another object of the present invention to provide a heating sheet which remains trouble-free even when one of the heating wires becomes disconnected.

In order to achieve the above objects of the present invention, there is provided a heating sheet comprising: a nonconductive fiber sheet; a plurality of heating wires fixed on a surface of said nonconductive fiber sheet so that said plurality of heating wires do not cross each other; and common power source terminals each having a plurality of conductors fixed on the surface of said nonconductive fiber sheet, said common power source terminals being connected to both end portions or at an intermediate portion of each of said plurality of heating wires such that said plurality of conductors cross said plurality of heating wires, said common power source terminals being connected to a low-voltage power source.

BRIEF DESCRIPTION OF THE DRAWINGS

FIG. 2(*b*) is a plan view of part of the heating sheet of FIG. 2(*a*), showing the connections between the terminal conductors and one of the heating wires;

DETAILED DESCRIPTION OF THE PREFERRED EMBODIMENTS

Figure 1A:
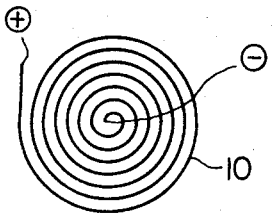
FIG. 1(a) PRIOR ART
FIGS. 1(*a*) and 1(*b*) are wiring diagrams of heating wires of a conventional electric heater or heating equipment, respectively.
Figure 1B:
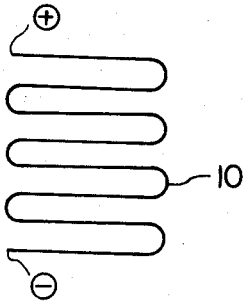
FIG. 1(b) PRIOR ART

Before describing embodiments of the present invention, a conventional electric heater or heating equipment will be described in order to facilitate understanding of the present invention. FIGS. 1(*a*) and 1(*b*) show the patterns of the single Nichrome wires used in conventional electric heaters or heating equipment, respectively. Referring to FIG. 1(*a*), a Nichrome wire 10 is formed in a spiral pattern. Referring to FIG. 1(*b*), a Nichrome wire 10 is formed in a zigzag pattern.

In the conventional electric heater or heating equipment, the Nichrome wire 10 comprises a single wire. If a disconnection occurs at part of the single wire, heating or warming cannot be performed, resulting in inconvenience.

Figure 2A:
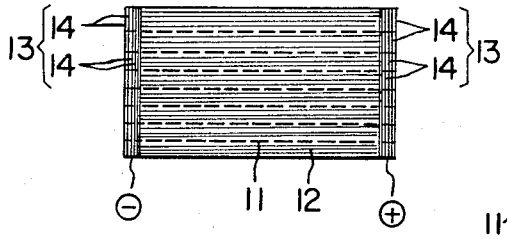
FIG. 2(*a*) is a plan view of a heating sheet according to an embodiment of the present invention.
Figure 2B:
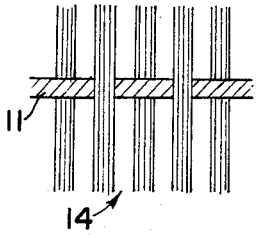

FIG. 2(*a*) is a plan view of heating sheet according to a first embodiment of the present invention. FIG. 2(*b*) shows the connections between the conductors 14 and the heating wires 11. A plurality of heating wires 11 which are substantially parallel to each other are fixed on a surface of a nonconductive fiber sheet 12 such as a nylon or cotton sheet. Common power source terminals 13 each of which comprises a plurality of conductors 14 are respectively fixed on the nonconductive fiber sheet 12 at the two ends of the respective heating wires 11, such that they cross the heating wires 11. The common power source terminals 13 are respectively connected to the positive and negative terminals of a DC or AC power source.

Figure 3:
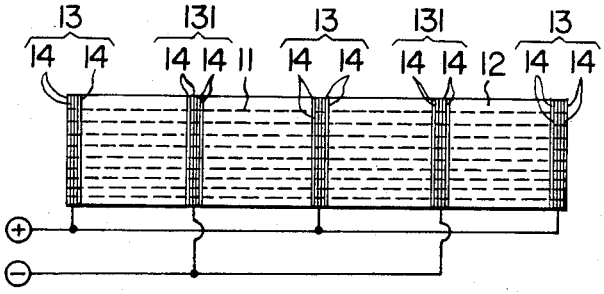
FIGS. 3 to 5 are, respectively, plan views of heating sheets according to other embodiments of the present invention.

FIG. 3 is a plan view of a heating sheet according to a second embodiment of the present invention. Heating wires 11 which are substantially parallel to each other are fixed on a nonconductive fiber sheet 12. A plurality of common power source terminals 13 (three terminals in this embodiment) are fixed on the nonconductive fiber sheet 12 at the two end portions and at a central portion of the heating wires 11 so as to cross the heating wires 11. These common power source terminals 13 are commonly connected to the positive terminal of a power source. Intermediate common power source terminals 131 are fixed on the nonconductive fiber sheet 12 between each pair of adjacent common power source terminals 13. The intermediate common power source terminals 131 are commonly connected to the negative terminal of the power source.

Figure 4:
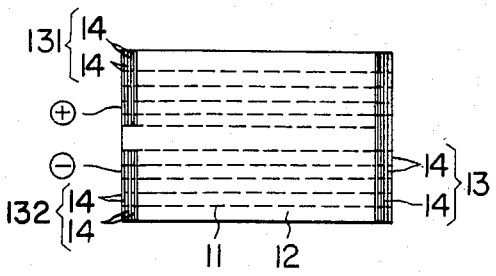

FIG. 4 is a plan view of a heating sheet according to a third embodiment of the present invention. The heating sheet of the third embodiment is substantially the same as that of the first embodiment, except that one of the common power source terminals 13 shown in FIG. 2(*a*) is divided into two common power source terminals 131 and 132. The common power source terminal 131 is connected to the positive terminal of a power source, whereas the common power source terminal 132 is connected to the negative terminal thereof.

In the heating sheets of the above embodiments of the present invention, even if one of the heating wires 11 becomes disconnected, the remaining heating wires 11 can still be heated. When the pitch between adjacent heating wires 11 is small, heating or warming is not substantially influenced by such a disconnection. It is noted that each common power source terminal 131,132 comprises a plurality of conductive wires or conductors 14 so as to increase a contact area of the terminal 13 with respect to the heating wires 11. If the power source terminal 13 comprises a single wire, undesirable heat is produced at a small contact portion between the single wire and a heating wire due to contact resistance. However, since the common power source terminal 13 comprises a plurality of conductors in the present invention, the effect of the contact resistance is substantially reduced.

Figure 5:
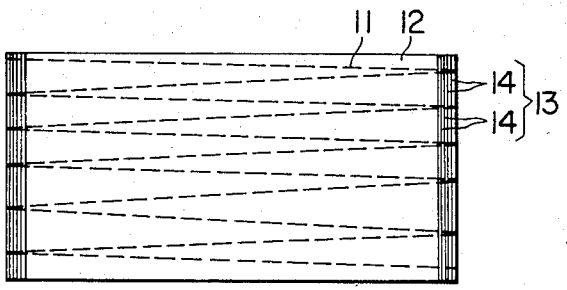

FIG. 5 is a plan view of a heating sheet according to a fourth embodiment of the present invention. In this embodiment, heating wires 11 are not fixed on a nonconductive fiber sheet 12 in a parallel pattern. The heating wires 11 are fixed on the nonconductive fiber sheet 12 in a zigzag pattern.

The heating sheet 12 having the above arrangement can provide the same effect as the embodiments mentioned previously with reference to FIGS. 2(*a*) to 4.

Figure 6A:
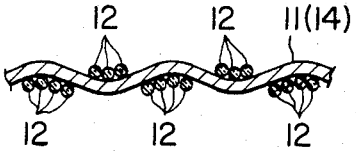
FIGS. 6(*a*) and 6(*b*) are, respectively, partial sectional views showing embodiments of the present invention in which the heating wires or the conductors of the common power source terminal are fixed on nonconductive fiber sheets.
Figure 6B:
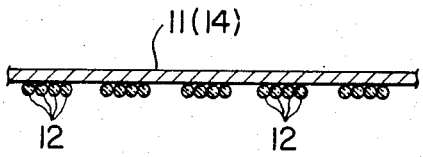

FIGS. 6(*a*) and 6(*b*) show respective arrangements of the heating wires 11 or conductors 14 of the common power source terminal 13 woven into the nonconductive fiber sheets 12 according to other embodiments of the present invention. In FIG. 6(*a*), the heating wires 11 or the conductors 14 of the common power source terminal 13 are alternately arranged on the upper surfaces of the nonconductive fiber sheet 12. Therefore, even if the conductors are slightly misaligned with the nonconductive fiber sheet 12, the conductors may not be removed therefrom. In FIG. 6(*b*), the heating wires 11 or the conductors 14 of the common power source terminal 13 are adhered to only one of the surfaces of the nonconductive fiber sheet 12, thus providing an easy manufacturing process.

Figure 7A:
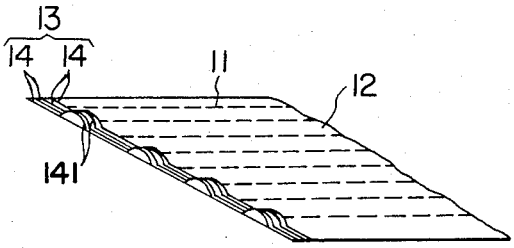
FIGS. 7(*a*) and 7(*b*) are, respectively, partial perspective views showing still another embodiment of the present invention in which the common power source terminals are mounted on the nonconductive fiber sheets.
Figure 7B:
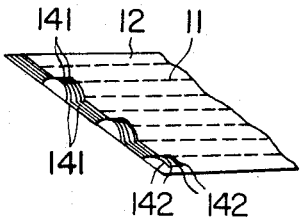

FIG. 7(*a*) shows still another embodiment in which conductors 14 of a common power source terminal 13 are fixed on a nonconductive fiber sheet 12 such that parts of the common power source terminal 13 at equal intervals along the common power source terminal 13 are of arcuate configuration, to be raised away from the surface of the nonconductive fiber sheet 12. With the above arrangement, when the conductive wires 14 are cut at an arcuate portion 141 in order to partially cut the heating sheet to obtain a partially cut heating sheet for a specific purpose as shown in FIG. 7(*b*), an end portion 142 of the conductors 14 is formed, to act as a lead. As a result, it is very convenient to connect the end portion 142 to a terminal of a power source.

Figure 8:
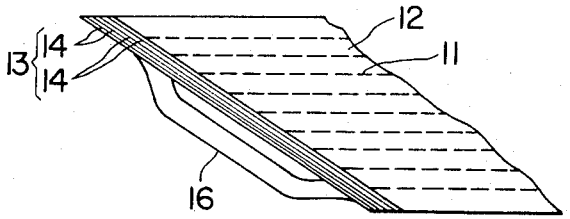
FIG. 8 is a partial perspective view showing still another embodiment of the present invention in which a metal film is connected in parallel with the conductors of the common power source terminal.

FIG. 8 shows still another embodiment in which a metal film 16 is connected to near-end portions of the common power source terminal 13.

For example, in the embodiment shown in FIG. 4, a total current flows through the common power source terminal 13 which is not divided into two parts or the like. Therefore, the current may exceed the current capacity of the conductors of the common power source terminal 13, thus overheating the conductors. The nonconductive fiber sheet 12 may then be burnt. Therefore, when the flexible metal film 16 is connected in parallel with the common power source terminal 13 through which an overcurrent flows, part of the overcurrent then flows through the metal film 16, thereby preventing overheating of the common power source terminal 13.

Paper or a fabric of synthetic fiber or cotton may be used as the nonconductive fiber sheet 12, and a very thin metal wire having a small resistivity such as a steel wire or a stainless steel wire is used as the heating wire. The heating wire of the heating sheet of the present invention is not heated to as high a temperature as the nichrome wire. The heating wire of the heating sheet is heated by a low-voltage power source to a relatively low temperature. An AC voltage of 100 V. is dropped by a transformer to supply a low voltage (e.g., 10 to 20 V.) to the common power source terminal 13. Alternatively, batteries may be used to supply the low voltage to the common power source terminal 13.

In the heating sheet of the present invention, the heating wires constitute a great number of parallel circuits or closed loops so that even if a heating wire is disconnected, heating or warming can still be performed by the energization of the remaining heating wires. Furthermore, since the heating sheet of the present invention is used to conduct heat to the body of the user by directly bringing the heating sheet into contact therewith, a high heat efficiency is obtained. As described above, the heating sheet is brought into contact with the body of the user, the heating sheet only having a slightly higher temperature than the user's temperature. A high voltage need not therefore be applied to the heating sheet and no fire or burning may occur, unlike with the nichrome wire.

In the heating sheet of the present invention, as a current flows through the heating sheet close to the body of the user, electromagnetic flux acts on the hemoglobin in the blood, thus obtaining a secondary effect, namely, improvement of blood circulation.

Figure 9:
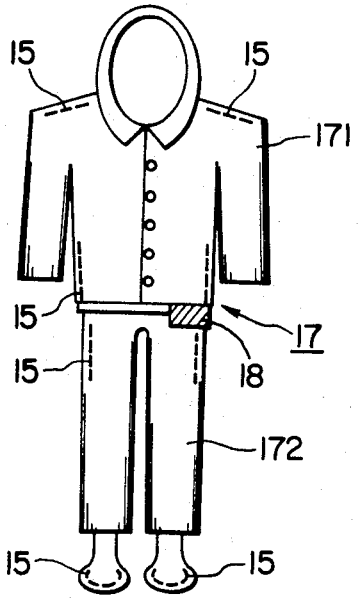
FIG. 9 is a schematic view showing working apparel or workwear which has a heating sheet on its inside surface.

An application example using the heating sheet of the present invention will be described. FIG. 9 is a front view of working apparel or workwear 17 which has the heating sheet of the present invention on its inner surface. Heating sheets 15 are attached to the inner surfaces corresponding to the shoulder, belly and back portions of a jecket 171 and to the hip and foot portions of a pair of trousers 172. Power is supplied from batteries 18 attached at the side of the body to the heating sheets 15.

When the heating sheets 15 are attached to the necessary inner surfaces of workwear 17, the user is kept warm and can comfortably work in the coldest environment.

Figure 10:
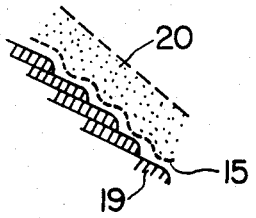
FIG. 10 is a partial sectional view showing the situation where a heating sheet is mounted on a roof to melt snow thereon.

FIG. 10 shows an application example in which heating sheets 15 are placed on a roof 19 so as to melt snow on the roof 19.

Figure 11:
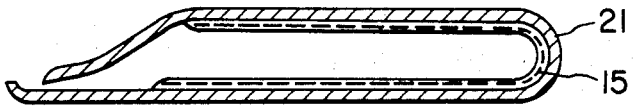
FIG. 11 is a sectional view showing a sleeping bag which has a heating sheet on its inner surface.

FIG. 11 is a partial sectional view showing a sleeping bag which has the heating sheet on its inner surface. Reference numeral 15 denotes a heating sheet; and 21, a sleeping bag. The batteries may be arranged at a proper position in the sleeping bag 21.

When the user uses the sleeping bag 21, a proper temperature is constantly maintained even in the coldest conditions, thereby guaranteeing sound sleep.

The heating sheet shown in FIG. 2 is suitable for heating small areas such as the workwear 17 shown in FIG. 9. The heating sheet shown in FIG. 3 is suitable for heating larger areas such as the roof 19 as shown in FIG. 10. The heating sheet shown in FIG. 4 is suitable for the sleeping bag 21 as shown in FIG. 11 since the common power source terminals are arranged at one end.

What is claimed is;

1. A heating sheet, comprising: a nonconductive fiber sheet; a plurality of heating wires fixed on at least one surface of said nonconductive fiber sheet and extending in a longitudinal direction so that said plurality of heating wires do not cross each other; and at least two common power source terminals each having a plurality of conductors fixed on at least said one surface of said nonconductive fiber sheet and extending in a transverse direction, each of said common power source terminals being connected to a corresponding or intermediate portion of a plurality of said heating wires such that each of said plurality of conductors crosses and is electrically connected to a corresponding plurality of heating wires, each of said common power source terminals having arcuate portions extending above or below said non-conductive fiber sheet at predetermined intervals; and means for connecting said common power source terminals to a low-voltage power source.

2. A heating sheet according to claim 1, wherein said plurality of heating wires are arranged substantially parallel to each other.

3. A heating sheet according to claim 1, wherein said plurality of heating wires are arranged in a zigzag pattern.

4. A heating sheet according to claim 1, wherein said nonconductive fiber sheet comprises fabric of a synthetic resin or cotton.

5. A heating sheet according to claim 1, wherein said nonconductive fiber sheet comprises paper.

6. A heating sheet according to claim 1, wherein one of said common power source terminals at one end of said nonconductive fiber sheet is divided into two terminal portions which are respectively connected to positive and negative terminals of said low-voltage power source.

7. A heating sheet, comprising: a nonconductive fiber sheet; a plurality of heating wires alternately fixed on opposed major surfaces of said nonconductive fiber sheet so that said plurality of heating wires do not cross each other; and at least two common power source terminals each having a plurality of conductors woven into said nonconductive fiber sheet, said common power source terminals being arranged at both ends or at an intermediate portion of said plurality of heating wires such that said plurality of conductors cross said plurality of heating wires and are electrically connected thereto, each of said common power source terminals having arcuate portions extending away from said major surfaces of said non-conductuve fiber sheet at predetermined intervals, said common power source terminals being adapted to be connected to a low-voltage power source.

8. A heating sheet according to claim 7, wherein said plurality of heating wires are arranged substantially parallel to each other.

9. A heating sheet according to claim 7, wherein said plurality of heating wires are arranged in a zigzag pattern.

10. A heating sheet according to claim 7, wherein said nonconductive fiber sheet comprises fabric of a synthetic resin or cotton.

11. A heating sheet according to claim 7, wherein said nonconductive fiber sheet comprises paper.

12. A heating sheet according to claim 7, wherein one of said common power source terminals at one end of said nonconductive fiber sheet is divided into two terminal portions which are respectively connected to positive and negative terminals of said low-voltage power source.

* * * * *